US009889503B2

(12) United States Patent
Lukesch et al.

(10) Patent No.: US 9,889,503 B2
(45) Date of Patent: Feb. 13, 2018

(54) FIREPROOF CERAMIC IMPACT PAD

(71) Applicant: REFRACTORY INTELLECTUAL PROPERTY GMBH & CO. KG, Vienna (AT)

(72) Inventors: Gernot Lukesch, Leoben (AT); Sarah Kohler, Leoben (AT); Gernot Hackl, Trofaiach (AT)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 64 days.

(21) Appl. No.: 14/907,879

(22) PCT Filed: Jul. 3, 2014

(86) PCT No.: PCT/EP2014/064230
§ 371 (c)(1),
(2) Date: Jan. 27, 2016

(87) PCT Pub. No.: WO2015/058870
PCT Pub. Date: Apr. 30, 2015

(65) Prior Publication Data

US 2016/0167124 A1 Jun. 16, 2016

(30) Foreign Application Priority Data

Oct. 22, 2013 (EP) ..... 13189666

(51) Int. Cl.
*B22D 41/00* (2006.01)

(52) U.S. Cl.
CPC ..... *B22D 41/003* (2013.01)

(58) Field of Classification Search
CPC ..... B22D 41/003
USPC ..... 266/275
See application file for complete search history.

(56) References Cited

U.S. PATENT DOCUMENTS

| | | | | |
|---|---|---|---|---|
| 5,133,535 | A | 7/1992 | Soofi | |
| 5,160,480 | A * | 11/1992 | Vassilicos | B22D 41/003 266/275 |
| 5,358,551 | A | 10/1994 | Saylor | |
| 2016/0167124 | A1 * | 6/2016 | Lukesch | B22D 41/003 266/275 |

FOREIGN PATENT DOCUMENTS

| | | |
|---|---|---|
| DE | 10202537 C1 | 1/2003 |
| DE | 10235867 B3 | 4/2004 |

OTHER PUBLICATIONS

International Search Report for App. No. PCT/EP2014/064230 dated Sep. 17, 2014.

* cited by examiner

*Primary Examiner* — Scott Kastler
(74) *Attorney, Agent, or Firm* — Medley, Behrens & Lewis, LLC

(57) ABSTRACT

The invention relates to a fireproof (refractory) ceramic impact pad (also called impact pot, German: Pralltopf), which is typically installed along the bottom of a vessel treating metallurgical melts at an area where the metal melt, poured into the vessel, normally hits the vessel bottom. Insofar the impact pot has the task to protect the refractory bottom of the metallurgical vessel (to reduce its wear) and/or to distribute the metal melt within the vessel.

14 Claims, 6 Drawing Sheets

FIREPROOF CERAMIC IMPACT PAD

Figure 1:
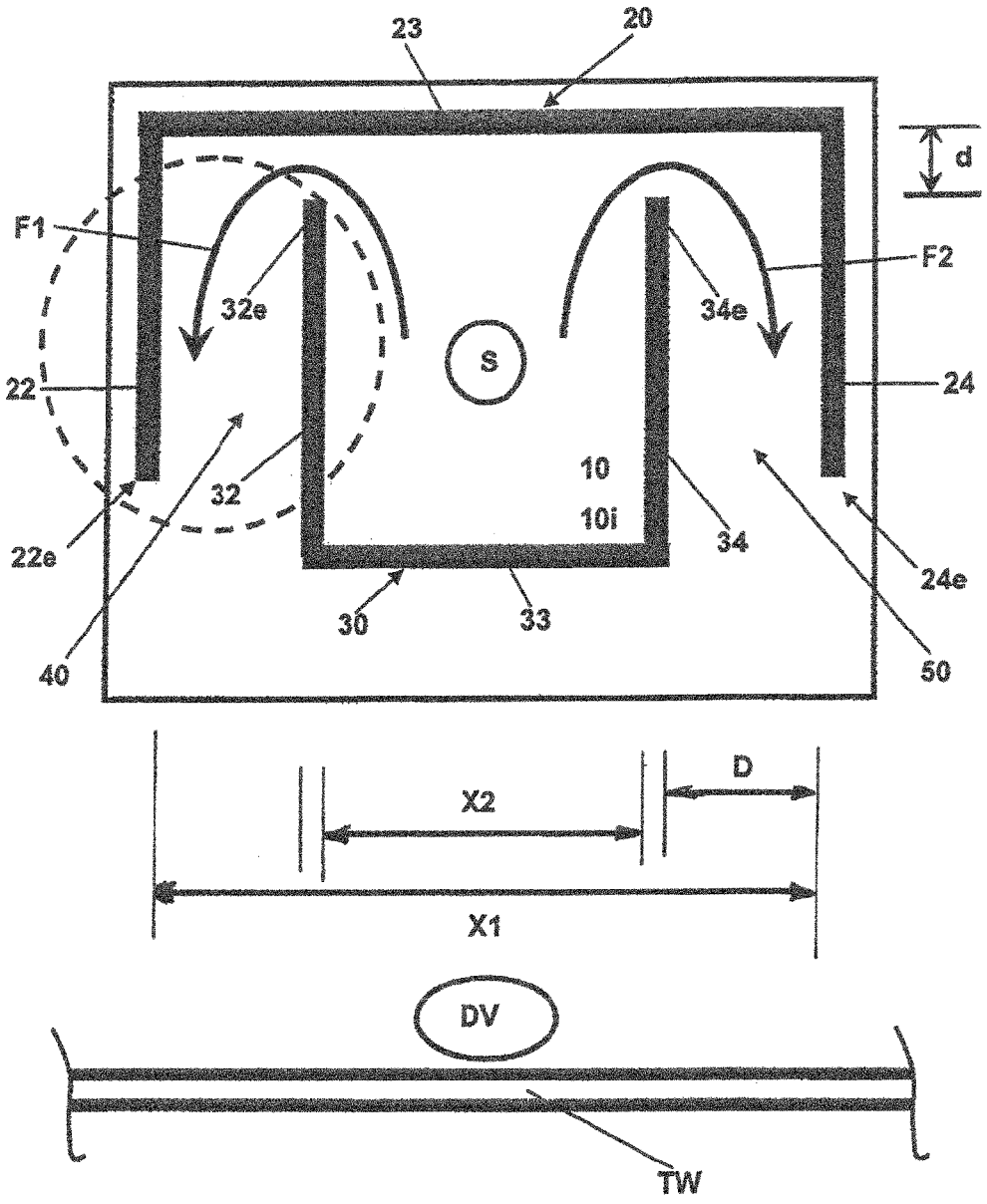

The invention relates to a fireproof (refractory) ceramic impact pad (also called impact pot, German: Pralltopf), which is typically installed along the bottom of a vessel treating metallurgical melts at an area where the metal melt, poured into the vessel, normally hits the vessel bottom. Insofar the impact pot has the task to protect the refractory bottom of the metallurgical vessel (to reduce its wear) and/or to distribute the metal melt within the vessel.

Hereinafter prior art impact pads as well as the new design will be described with respect to the regular use position of this functional ceramic item in a corresponding metallurgical vessel.

Numerous attempts have been made to improve such an impact pad.

The impact pad according to U.S. Pat. No. 5,358,551 has a classical pot-shape wherein the free upper end segment of the wall is turned inwardly. After clashing against the base of the impact pad the metal melt initially flows along the base, then upwards along the inside of the wall and finally around the narrowed impact pad opening upwards into the vessel.

DE 102 35 867 B3 discloses an impact pad with a so called diffuser at its upper open end, which means that the cross-section of the impact pad is increasing towards the upper outlet-end to reduce the kinetic energy of the effusing melt.

DE 102 02 537 C1 includes an impact pad, whose wall is featuring at least one slit. Accordingly the metal melt entering the impact pad drains at least partially through the wall-sided slit. Because of the relatively small slit width, the metal melt flowing through the slit can feature a significant flow speed. Thereby, further flow turbulences are caused.

The essay "Melt flow characterisation in Continuous Casting Tundishes" (ISIJ International, Vol. 36 (1996), No. 6, p. 667-672) defines a so called plug flow, wherein all fluid elements have the same residence time in the tundish and a so called dead volume. The dead volume characterises the fluid part, whose residence time is more than double of the average residence time of the melt in the tundish.

In typical tundish (German: Verteiler, Tundish) applications the impact pot is arranged at one end of the tundish; in other words: offset its length. This leads to considerable dead zones between the impact pot and the closest end wall of the tundish.

It is the main object of the invention to improve the melt distribution properties of an impact pot and/or to minimize dead volumes in the corresponding metallurgical vessel.

Details in the following are related to a common function of the impact pad (functional position), wherein the bottom of the impact pad lies on or in the base of a metallurgical vessel (or is part of said base of the metallurgical vessel) and wherein the walls of the impact pad extend perpendicular to the bottom and thereby mainly perpendicular to the base of the metallurgic vessel in an upward direction. The term "perpendicular" does not necessarily corresponds to exactly 90° but includes any inclinations which are technically acceptable to achieve the desired impact pad function, typically ±30° or +/−20° or +/−10° or less to a right angle.

In order to design an impact pad, which fulfils these objects, extensive tests and investigations have been conducted, particularly regarding improved flow properties of the metal melt. In doing so, the following has been investigated and found:

- The dead volume in the metallurgical vessel is mainly caused by insufficient velocity (turbulence) of the melt in this area
- The insufficient velocity if the melt stream is caused by the offset position of the impact pad within the vessel
- The impact design should be amended such that a directed melt flow into these formerly "dead volumes" can be achieved
- Such requirement may be achieved by a horizontally meandering melt flow pattern within the impact pad, i.e. between the area where the melt hits the bottom of the pad and the outlet area
- This can be realized by a flow pattern which is characterized by a kind of a U-turn of the melt stream before the melt leaves the impact pad via a corresponding outlet opening
- This cognition further leads to the finding that the outlet opening should be provided by a channel type outlet passage instead of a slit or hole with almost no wall guidance Insofar the invention leaves known designs of impact pots with a more or less closed (continuous) wall but splits the one wall into at least two walls (hereinafter called the first and second wall) which are arranged distinct to each other but in an overlapping fashion to as to provide the said required outflow channel.

This allows a very simple general design, easy and cheap to produce, with improved flow behaviour to the melt.

In its most general embodiment the invention relates to a fireproof ceramic impact pad with the following features in its functional position:

- a bottom; defining an upper impact surface,
- a first wall, extending upwardly from said bottom and providing at least one of the following shapes in a top view: C, U, V, W, E, 3, with opposed free end sections having a minimum distance X1 to each other,
- a second wall, extending upwardly from said bottom and providing at least one of the following shapes in a top view: C, U, V, W, E, 3, with opposed free end sections having a maximum distance X2 to each other, wherein X1 being larger than X2,
- the free end sections of the second wall section are arranged between the first end sections of the first wall,
- the free end sections of the first wall overlap the free end sections of the second wall in a horizontal direction,
- a channel is formed between adjacent free end sections of said first wall and said second wall.

To achieve the desired meandering flow of the melt or at least one U-turn of the melt flow, the said first and second wall are arranged "opposite to each other", i.e. in some kind of a "mirror-inverted way;

in other words: With free end sections of one wall extending oppositely to the free end sections of the other wall, for example two end sections of one wall protruding into the space between two end sections of the other wall, as illustrated hereinafter. "Oppositely" and "mirror-inverted" does not mean exactly oppositely or in a mirror design but in a different orientation.

Referring to the wall shapes the following should be noted: They are characterized by two end sections which protrude (in a horizontal direction) from at least one main section (in between) by an angle unequal to 180°. This angle may be set between a lower value of 30° and an upper value of 150° with typical lower values at 50°, 60°, 70° and typical upper values at 110°, 120°, 130°, 140°. With an angle <90° the distance X1 between the free ends of opposed free end sections is smaller than the width of the intermediate main section of the corresponding wall, while it is larger in a design with at least one angle being >90°.

This allows to arrange the two walls such that adjacent end sections of the first wall and the second wall may form a channel-like outflow area between them, which channel may have parallel extending walls, diverging walls and converging walls (always seen in the flow direction of a corresponding melt).

The length of a corresponding channel is dependent on the arrangement of the corresponding (adjacent) end sections of first and second wall.

This may be achieved according to those features of claim 1 defining the distances (X1, X2) of the end sections of first and second wall as well as the arrangement of these end sections to each other.

The following example explains the general idea, which may be varied according to different sizes, different shapes etc. of the respecting walls and wall end sections and their free ends (edges):

In case of an impact pad with a first wall with a U-shape and a second wall with a U-shape (but of smaller size) the second U may be arranged "into" the larger U while keeping a distance between the free ends of the end sections of the smaller U to the main (intermediate) wall area of the first wall. This design allows two outflow areas between the respective end sections of first and second wall and urges the corresponding melt to make a curve like a U-turn before leaving the impact pad.

This allows to direct the melt stream flowing along the respective channels into the desired direction, while excess melt may overflow the said two walls in any other direction.

From the aforesaid it derives that the disclosed shape of first wall and second wall (C, U, V, W, E, 3) only defines the general shape of the corresponding wall and includes variations which keep the general idea of two walls, arranged in an overlapping way to allow corresponding outflow channels between corresponding end sections of said walls, which channels are arranged in such a way that the corresponding melt within the impact pad must make at least one turn before flowing out of the said pad.

According to one embodiment at least one of said free end sections of said first and second wall is planar. This is in particular true with a wall shape (in a top view) similar to a U, V, W, E.

At least one of said free end sections of said first and second wall may also be curved about a vertical axis. This is realized in wall shapes (in a top view) which mainly follow a C or numeral 3.

At least part of the first wall or second wall may be planar between the at least two end sections. This design may be realized with a wall having a U-, V-, W-, E-shape, while curved areas between the at least two end sections may be realized for example by a C- or W- or 3-shape (in a top view) of said first and/or second wall.

According to the general design the walls of the new impact pad are at least fixed in the bottom of the impact pad. In this respect a lower end section of at least one of said first wall or second wall may be inserted into at least one corresponding pocket provided within said bottom. The walls may have different heights and upper rims protruding horizontally.

Another option to fix wall and bottom is to design bottom and wall(s) as one monolithic piece. Such an impact pad may be manufactured by casting or in a corresponding press like a hydraulic press or an isostatic press.

The invention includes embodiments wherein the bottom of the impact pad is provided by the bottom of the corresponding vessel, meaning that the walls are then fixed within the bottom of the vessel.

Further material bridges may be provided between adjacent free end sections of said first and second wall to increase the stability of the overall impact pad.

Again at least one material bridge can be arranged between the main parts of said first and second wall for the same purpose.

Further aspects of the invention may be derived from the features of the sub claims and the other application documents. These include various examples according to the attached schematic drawing, wherein the following is shown:

FIG. 1: A top view of a refractory ceramic impact pad according to the invention.

FIGS. 2-14: Top views of various design options.

Figure 14:
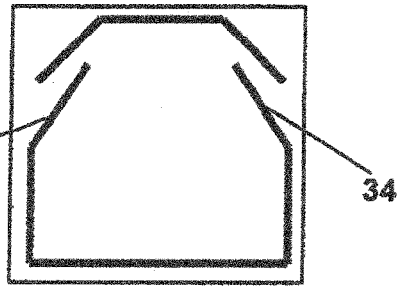
Figure 15:
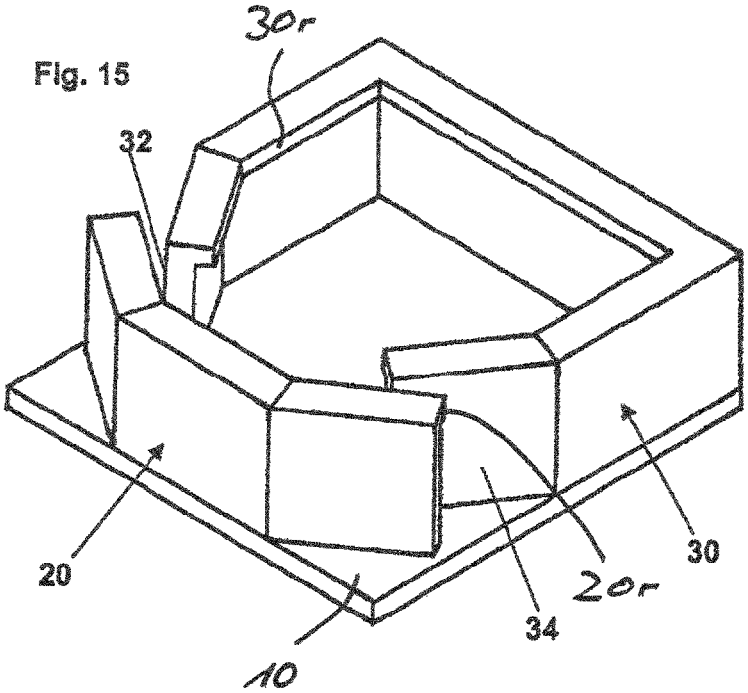

FIG. 15: A three-dimensional view of the impact pad according to FIG. 14.

Figure 16:
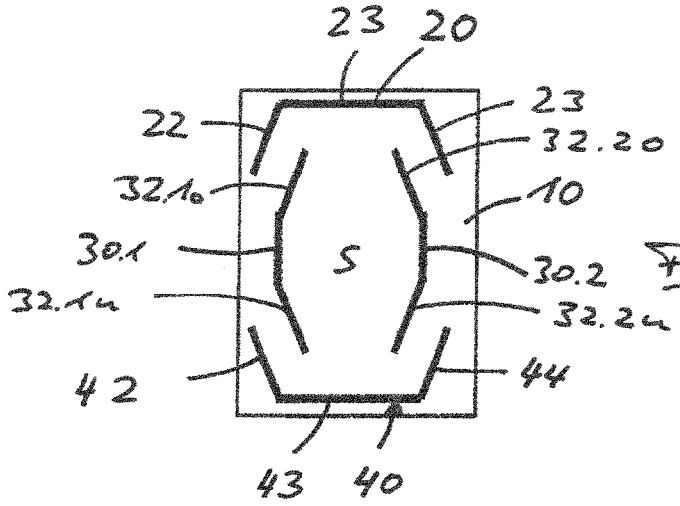
Figure 17:
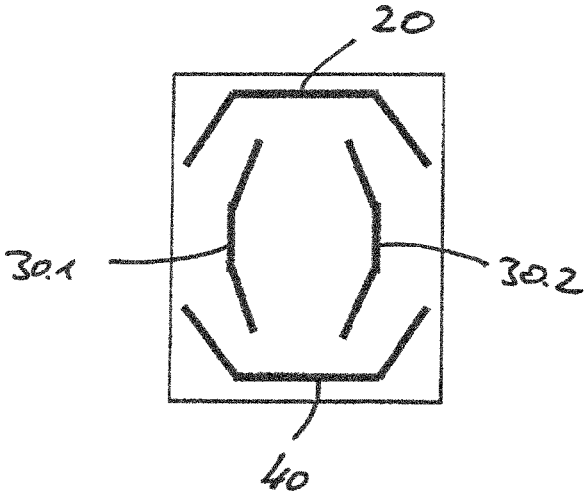
Figure 18:
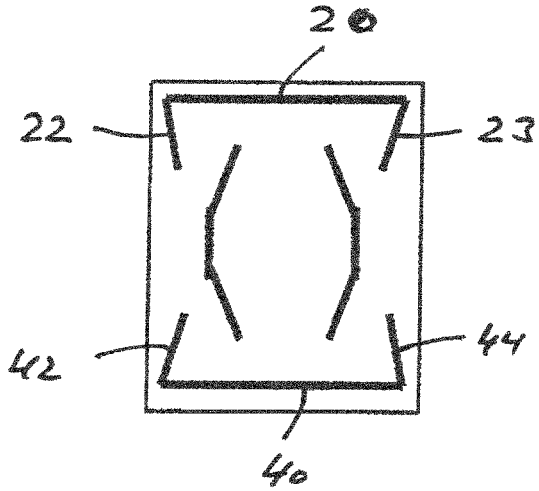

FIGS. 16-18: FIGS. 16-18 represent further embodiments of a refractory ceramic impact pad.

In the Figures identical parts or parts of at least similar function are characterized by the same numerals.

The impact according to FIG. 1 is a refractory (fireproof) ceramic impact pad with the following features in its functional position.

Bottom 10, defining an upper impact surface 10*i*, a first wall 20, extending upwardly from said bottom 10 and providing a U-shape in the top view as shown, including two opposed free end sections 22, 24, extending at a right angle from an intermediate main wall section 23. Free ends 22*e*, 24*e* have a distance X1 to each other.

A second wall 30, again of U-shape (in the top view) with a main wall section 33 and end sections 32, 34, again running at a right angle to main section 33. Free ends 32*e*, 34*e* of said end sections 32, 34 have a distance X2 to each other.

X1 is larger than X2 plus the wall thicknesses of end sections 32*e*, 34*e*.

The free end sections 32, 34 of second wall 30 are arranged between the free end sections 22, 24 of said first wall 20, wherein the free end sections 22, 24 of said first wall 20 overlap the free end sections 32, 34 of the second wall 30 in a horizontal direction, thus forming channels 40, 50 between adjacent free end sections, 22, 32; 24, 34 of said first wall 20 and second wall 30. The overlapping/channel area is encircled in FIG. 1.

As the free ends 32*e*, 34*e* of second wall 30 are arranged at a distance d to the main wall section 23 of first wall 20 a meander-like flow pattern can be realized for the metal melt after hitting a central spot area S of the impact pad, wherein the flow streams are symbolized by arrows F1, F2. In other words, after the melt enters the space defined by U-shaped second wall 30 it firstly flows towards the main portion 23 of first wall 20 and then makes the U-turn to flow through channels 40, 50 each of width D out of said impact pad.

In FIG. 1 D>d but it may be as well the other way round.

According to the volume of melt poured into the impact pad further melt will overflow the top rims 20*r* or 30*r* of first wall 20 and second wall 30.

The redirection of the metal flow allows to direct the melt stream into formerly "dead volumes" within the corresponding metallurgical vessel and thus provides a considerable improvement in homogeneity of the melt within the metallurgical treatment vessel. The area of these "dead volumes" is marked as DV while a corresponding tundish wall is marked as TW.

Figure 2:
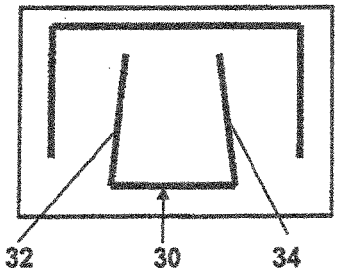

The embodiment according to FIGS. 2-14 follow the general design of the impact pad according to FIG. 1 with the following amendments:

FIG. 2: converging end sections 32, 34 of wall 30.

Figure 3:
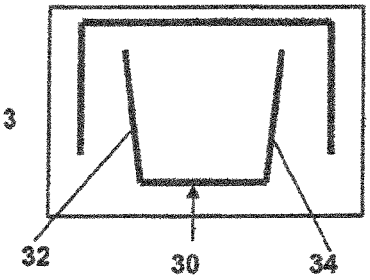

FIG. 3: diverging end sections 32, 34 of wall 30.

Figure 4:
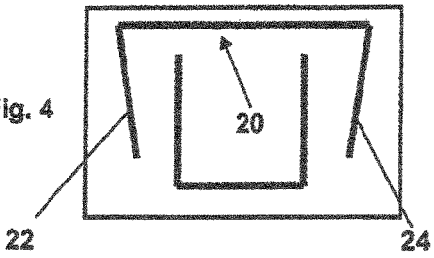

FIG. 4: converging end sections 22, 24 of wall 20.

Figure 5:
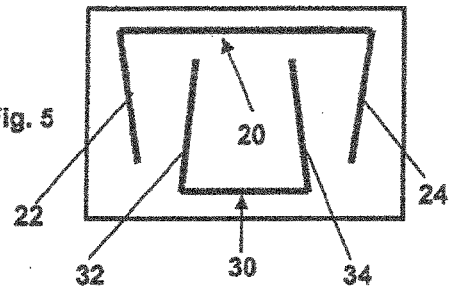

FIG. 5: converging end sections 22, 24; 32, 34 of walls 20, 30.

Figure 6:
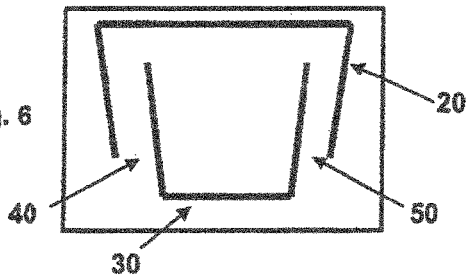

FIG. 6: converging end sections of wall 20 and diverging end sections of wall 30 to achieve channels 40, 50 of constant width.

Figure 7:
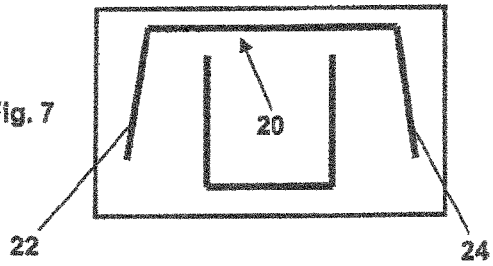

FIG. 7: diverging end sections 22, 24 of wall 20.

Figure 8:
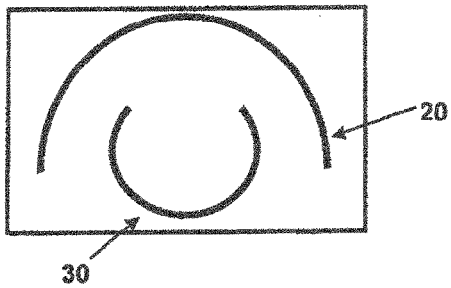

FIG. 8: C-shaped walls 20, 30.

Figure 9:
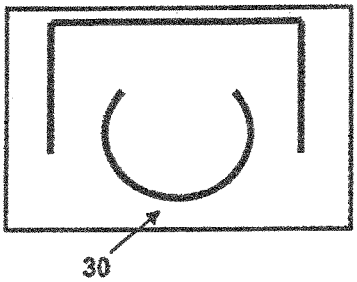

FIG. 9: C-shaped wall 30.

Figure 10:
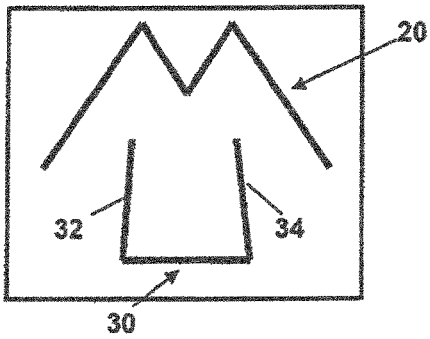

FIG. 10: W-shaped wall 20 and converging end sections 32, 34 of wall 30.

Figure 11:
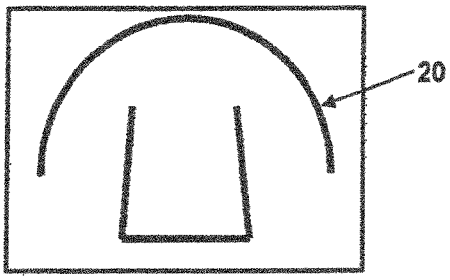

FIG. 11: as FIG. 10 but with C-shaped wall 20.

Figure 12:
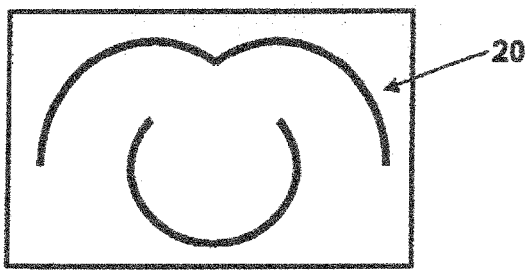

FIG. 12: as FIG. 9 but with 3-shaped wall 20.

Figure 13:
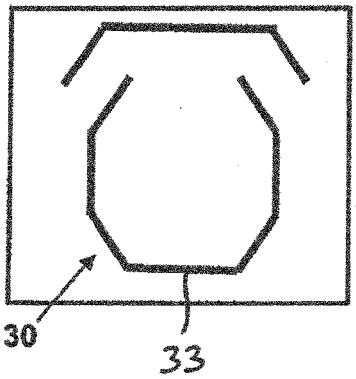

FIG. 13: as FIG. 7 but with wall 30 providing an angled wall portion.

FIG. 14: as FIG. 7 but with angled end sections 32, 34.

In all FIGS. 2-14 the rectangular area 10 symbolizes a bottom 10 of the corresponding impact pad.

The embodiment of FIG. 15 corresponds to FIG. 14 with the proviso that top rims 20*r*, 30*r* of walls 20, 30 protrude the corresponding lower (adjacent) wall sections of said walls 20, 30, wherein said rims 20*r*, 30*r* extend substantially parallel to bottom 10.

FIGS. 16 to 18 represent further embodiments of a refractory ceramic impact pad. All of them distinguish over embodiments according to FIGS. 1 to 15 in that they comprise additional walls extending from bottom 10.

Starting from the embodiment and view according to FIG. 13, the embodiment of FIG. 16 is characterized by a third wall 40, designed as wall 20 and arranged in a mirror-inverted fashion so that its opposed free end sections 42, 44 protrude intermediate wall section 43 towards wall 20.

Compared with the embodiment of FIG. 13 wall 30 is split into two parts 30.1, 30.2 by omitting intermediate wall portion 33. Accordingly each wall portion 30.1, 30.2 is characterized by three sub-sections angled to each other.

A metal melt, hitting spot area S, may flow along wall sections 30.1, 30.2 towards walls 20, 40 before being redirected and flowing through channel areas defined by corresponding end sections 22, 32.1*o*; 23, 32.2*o*; 32.2*u*, 44; 42, 32.1*u*.

The embodiment of FIG. 17 again is a top view of an impact pad, which differs from the embodiment of FIG. 16 just by the angles between adjacent wall sections.

The same is true with respect to the embodiment of FIG. 18 compared with that of FIG. 16 with the further proviso that end sections 22, 23 of wall 20 and end sections 42, 44 of wall 40 are arranged in a converging fashion to each other.

The invention claimed is:

1. Fireproof ceramic impact pad with the following features in its functional position:

1.1 a bottom (10) defining an upper impact surface (10*i*), 1.2 a first wall (20), extending upwardly from said bottom (10) and providing at least one of the following shapes in a top view: C, U, V, W, E, 3, with opposed free end sections (22, 24) having a minimum distance X1 to each other, 1.3 a second wall (30), extending upwardly from said bottom (10) and providing at least one of the following shapes in a top view: C, U, V, W, E, 3, with opposed free end sections (32, 34) having a maximum distance X2 to each other, wherein 1.4 X1 being larger than X2, 1.5 the free end sections (32, 34) of the second wall (30) are arranged between the free end sections (22, 24) of the first wall (20), 1.6 the free end sections (22, 24) of the first wall (20) overlap the free end sections (32, 34) of the second wall (30) in a horizontal direction, to allow 1.7 corresponding outflow channels (40, 50) being formed between adjacent free end sections (22, 24) of said first wall (20) and said second wall (30), 1.8 which outflow channels (40, 50) are arranged in such a way that substantially all of the corresponding melt within the impact pad receives a horizontally meandering flow pattern within the impact pad, including a U-turn before flowing out of the impact pad, free end sections (22, 24) of the first wall (20) extend oppositely to the free end sections (32, 34) of the second wall (30).

2. Fireproof ceramic impact pad according to claim 1, wherein adjacent free end sections (22, 24; 32, 34) of said first and second wall (20, 30) are arranged parallel to each other.

3. Fireproof ceramic impact pad according to claim 1, wherein adjacent free end sections (22, 24; 32, 34) of said first and second wall (20, 30) are arranged in a converging manner to each other.

4. Fireproof ceramic impact pad according to claim 1, wherein adjacent free end sections (22, 24; 32, 34) of said first and second wall (20, 30) are arranged in a diverging manner to each other.

5. Fireproof ceramic impact pad according to claim 1, wherein at least one of said free end sections (22, 24; 32, 34) of said first and second wall (20, 30) is planar.

6. Fireproof ceramic impact pad according to claim 1, wherein at least one of said free end sections (22, 24; 32, 34) of said first and second wall (20, 30) are curved about a vertical axis.

7. Fireproof ceramic impact pad according to claim 1, wherein at least part of the first wall (20) is planar between the at least two end sections (22, 24).

8. Fireproof ceramic impact pad according to claim 1 with at least one material bridge between said first and second wall (30).

9. Fireproof ceramic impact pad according to claim 1 with at least one material bridge between adjacent free end sections (22, 32; 24, 34) of said first and second wall (20, 30).

10. Fireproof ceramic impact pad according to claim 1, wherein a lower end section of at least one of said first wall (20) or second wall (30) is inserted into at least one corresponding pocket provided within said bottom (10).

11. Fireproof ceramic impact pad according to claim 1, wherein the bottom (10) and at least one of said first wall (20) or second wall (30) are designed as one monolithic piece.

12. Fireproof ceramic impact pad according to claim 1, wherein said first wall (20) and second wall (30) have different heights perpendicular to said bottom (10).

13. Fireproof ceramic impact pad according to claim 1, wherein at least one of said first wall (20) or second wall (30) provides an upper rim (20*r*, 30*r*) protruding an adjacent wall section in at least one direction parallel to the bottom (10).

14. Fireproof ceramic impact pad according to claim 13, wherein said rim (20*r*, 30*r*) protrudes towards an area of said pad, where a corresponding melt hits the bottom (10).

* * * * *